United States Patent [19]

Gruber et al.

[11] Patent Number: 5,009,100

[45] Date of Patent: Apr. 23, 1991

[54] DOWN HOLE RESERVOIR FLUID SAMPLER

[75] Inventors: Norman G. Gruber; Owen T. Krauss, both of Calgary, Canada

[73] Assignee: Western Atlas International, Inc., Houston, Tex.

[21] Appl. No.: 437,687

[22] Filed: Nov. 16, 1989

[30] Foreign Application Priority Data

Nov. 17, 1988 [CA] Canada ..... 583396

[51] Int. Cl.[5] ..... E21B 49/08

[52] U.S. Cl. ..... 73/155

[58] Field of Search ..... 73/151, 155, 864.63, 73/864.73, 864.74, 155; 166/163, 264

[56] References Cited

U.S. PATENT DOCUMENTS 3,095,930 7/1963 Kisling ..... 73/864.63

4,811,599 3/1989 Johnson et al. ..... 73/155

*Primary Examiner*—Jerry W. Myracle

*Attorney, Agent, or Firm*—Barry C. Kane

[57] ABSTRACT

A wire line sampler is disclosed for extracting a sample of fluid from a predetermined depth in a bore hole. The sampler may be an elongate housing having an interior volume which is connected to the exterior of the tool through a port. The housing contains an assembly for opening the port to allow the bore hole fluid to enter the housing interior upon command of an operator located at the surface. A flow restriction assembly is also provided to control the rate at which the fluid enters. A piston located within the housing closes the port once a sufficient amount of sample has been collected. The collected sample is maintained at the collection pressure without the fear of contamination from fluids at shallower depths and from explosive decompression as the sample is retrieved.

30 Claims, 6 Drawing Sheets

DOWN HOLE RESERVOIR FLUID SAMPLER

BACKGROUND OF THE INVENTION

1. Field of the Invention

Often in the oil industry it is desirable to obtain information on the physical properties of a reservoir fluid as it exists in the formation. To obtain a sample of this fluid, it is necessary to send a device which can trap a sample of the fluid, down a well penetrating the formation. The device must be able to operate in caustic environments under extreme pressure and temperature. The acquired sample is then transferred from the sampling device, under the pressure at which it was obtained, to another vessel and shipped to a laboratory for analysis. During the sampling and transfer process, it is always necessary to maintain the integrity of the vessel, avoiding any leakage from the sampling device and shipping vessel. If leakage does occur, the phase or composition of the fluid may change as the more volatile and lighter substances evolve and escape. If this occurs, the sample is no longer representative of the fluid in the formation.

Fluid samplers traditionally used, in the industry have been described in U.S. Pat. No. 4,799,389 assigned to the assignee of this invention. In general, a typical fluid sampler consists of a steel tubular housing containing an internal spring mechanism for pushing stoppers or valves outward to seal each end of the housing. The housing and one valve are usually attached to an activation head for triggering the closing of the valves. The activation head usually contains an electric motor coupled to the surface through an electrical conductor. A pulse is passed down the conductor at an appropriate time to energize the motor and trigger the closing of the valves in the sampler. This system is unreliable and often triggers prematurely before reaching the zone of interest. Moreover, it is difficult to effectively transfer the fluid sample from the sampling device to another vessel without experiencing some leakage. In addition, the sampling device often leaks because of the internal pressures exerted upon the valves as the sampler is raised to the surface.

It is an object of this invention to provide an apparatus for reliably collecting fluid samples from desired depths.

It is also an object of this invention to provide an apparatus which will not leak once the fluid has been sampled, thereby not allowing important constituents of the fluid to escape.

SUMMARY OF THE INVENTION

The instant invention comprises a new bore hole fluid sampling device which is capable of operating efficiently and reliably in environments often too hostile for previous fluid samplers. Moreover, the fluid sampler of this invention maintains the integrity of the fluid sample as it is brought to the surface, preventing the more volatile substances from escaping from the fluid.

In general, the fluid sampler is comprised of several interconnecting components, which interact to collect a sample of fluid at a desired depth. The fluid sampler basically has a sample chamber containing a viscous fluid which is displaced by the ambient pressure exerted by the sampled fluid. A triggering mechanism operated by an electrically driven motor or mechanical clock, releases a gas operated piston within the sampler. The gas operated piston is detachably coupled to an intake piston which blocks inlet ports for allowing the fluid to enter. The gas operated piston draws the intake piston upwards, allowing the fluid to enter. The ambient pressure of the fluid causes the fluid to enter into the low pressure sample chamber, forcing a floating piston to drive the viscous fluid into a secondary chamber. The resistance provided by the viscous fluid controls the rate at which the sampled fluid enters the sample chamber. The sampled fluid drives the floating piston against a stop which closes the intake piston over the inlet ports. The relationship between the intake piston and the floating piston is such that the internal pressure exerted by the sampled fluid keeps the inlet ports closed and prevents the sampled fluid from escaping.

BRIEF DESCRIPTION OF THE DRAWING FIGURES

A better understanding of the benefits and advantages of our invention may be obtained from the appended detailed description and drawings, wherein.

DETAILED DESCRIPTION OF A PREFERRED EMBODIMENT

Figure 1:
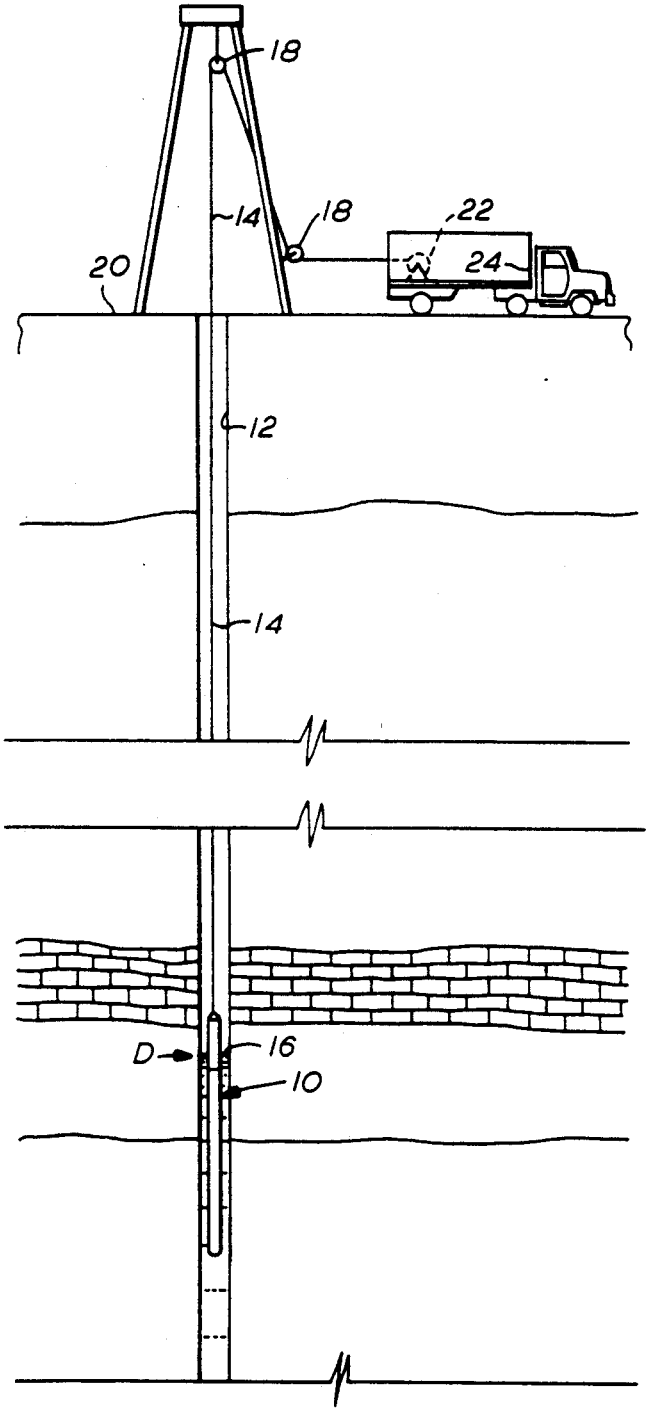
FIG. 1 is a general illustration of the inventive fluid sampler disposed in a bore hole.

FIG. 1 is a general illustration of the inventive fluid sampler 10 disposed in a bore hole 12 containing a fluid 16 to be sampled. The sampler 10 is suspended in the bore hole 12 by a wire line 14 at the desired depth D where the desired bore hole fluid 16 to be sampled is located. The wire line 14 passes through a series of pulleys 18 located at the surface 20 of the earth and is connected to a draw works 22 attached to a transportable platform 24 such as a truck or the like.

Figure 2:
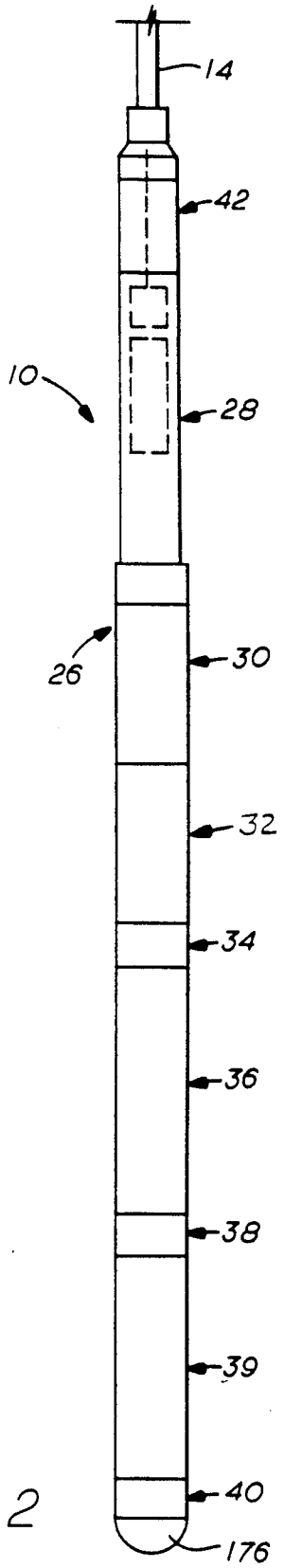
FIGS. 2 is an enlarged illustration of the fluid sampler.

FIGS. 2 provides a slightly enlarged illustration of the sampler 10. In general the sampler 10 has an elongate housing 26 comprised of a motor/clock section 28, a discharge cell 30, a pneumatic activation cell 32, an intake sub 34, a sample cell 36, a restriction sub 38, a secondary chamber 39, and a bleed-off or relief sub 40, coupled end-to-end. It is preferred the components comprising the sampler 10 be made from stainless steel or other high strength material resistant to caustic substances such as hydrogen sulfide which can be present in certain bore hole fluids. It is also preferred, but not required, that all of the connections between the different components contain dual seals to provide maximum fluid-tight integrity. The dual seal configuration prevents explosive decompression of the tool while being raised to the surface after sample collection. For the sake of simplicity, the dual seal configuration is not shown in the Figures.

Figure 3A:
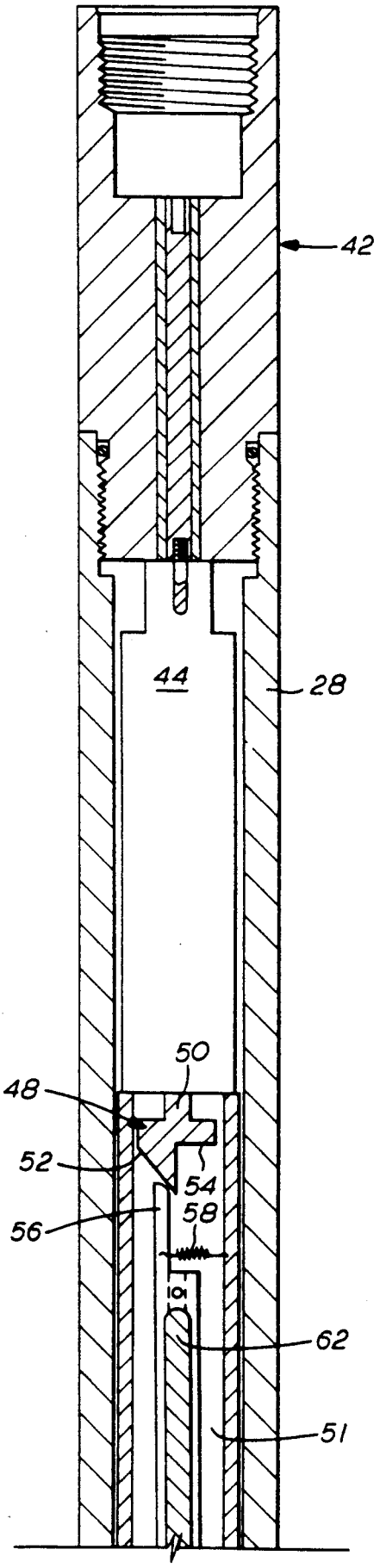
FIGS. 3A-3E are schematic illustrations of the interconnected components comprising the inventive fluid sampler.

Located near the top of the tool is the motor/clock section 28 and shown in FIG. 3A. The top of the motor/clock is coupled to a universal adaptor or cable head 42 which couples the tool to the wire line 14 and makes the electrical connections. The motor/clock section 28 may contain an electrical motor 44 which could be operably coupled to a power source through the wire line 14. Alternatively, the motor/head section 28 Could contain a spring or electrically driven clock 46: the clock in turn may activate or release a trigger after a period of time has elapsed. In an embodiment using the motor 44, a cam 48 may be attached to a lower shaft 50 extending into a cavity 51 defined within the section 28. The cam may have a conical face 52 with a portion milled away forming a slot 54. Urged against the conical face of the cam 48 may be one end of a trigger 56 held against the cam face 52 by a spring 58 attached to the inner wall of the cavity 51.

Figure 3B:
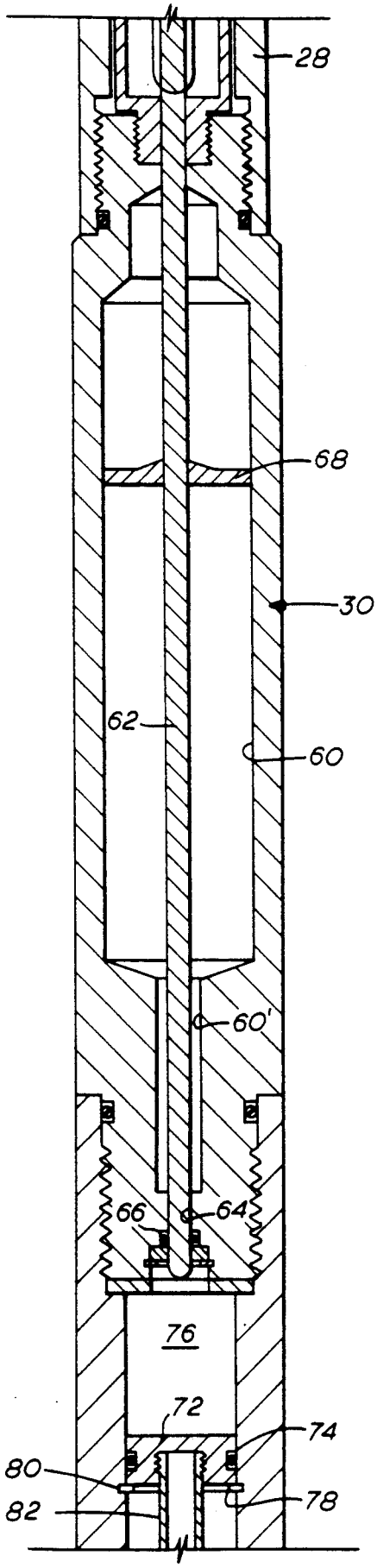

Coupled beneath the motor/clock section 28, and shown in FIG. 3B, is a discharge cell 30. A longitudinal passage 60 extends the entire length of the cell, forming a reduced diameter portion 60' towards the lower end. Axially disposed within the discharge cell 30 is an activation stem 62. The upper end of the activation stem 62 extends into the motor/clock section 28 and may be coupled to the trigger 56. The lower end of the activation stem 62 may be received by the reduced diameter portion 60' of the longitudinal passage 60, and extends through a port 64. An 0-ring 66 located in the port forms a seal about the activation stem 62 when the stem is in place. Located midway along the activation stem 62 may be a centralizer 68. Centralizer 68 acts as a stop to control the extent of upward travel of rod 62 by coming to rest against the reduced diameter portion of the top of the longitudinal passage 60 during the actuation sequence after release of trigger 56. Centralizer 68 also acts to support the activation stem within the cavity 60 during the actuation sequence.

Figure 3C:
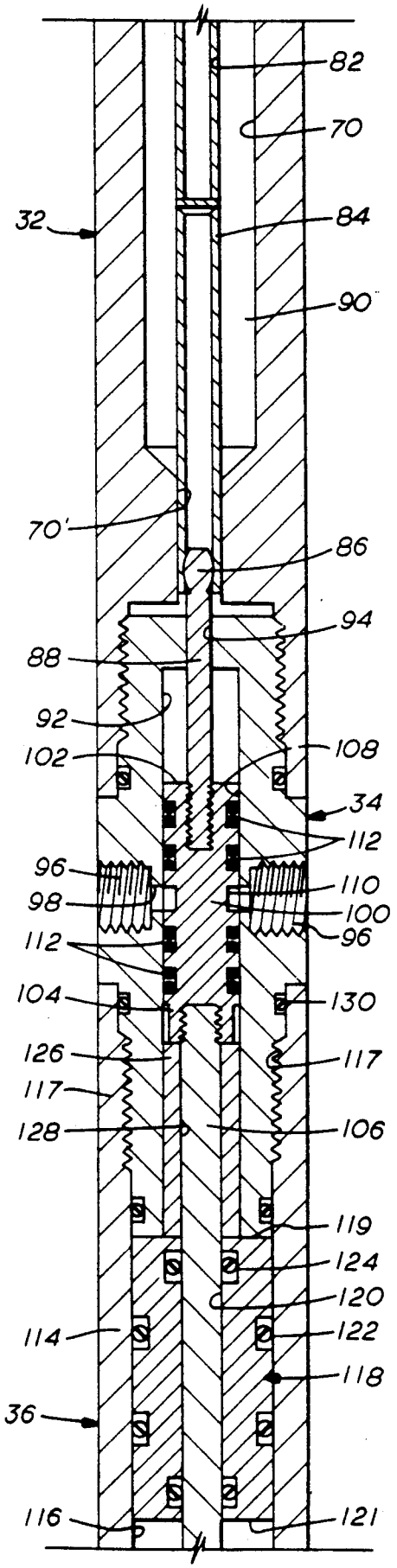

FIG. 3C generally illustrates an activation cell 32 which may be coupled beneath the discharge cell 30. The activation cell may be threaded to the discharge cell 30 as may be all of the components comprising the sampler 1? . The activation cell 32, which acts like a fluid-operated ram, contains an axial passage 70, concentric with the longitudinal passage 60, and extends the length of the unit 32. Towards the lower portion of the cell 32, the axial passage 70 tapers to a reduced diameter portion 70' before exiting the end of the unit. Disposed within the axial passage 70 may be a piston 72 containing an 0-ring 74 around its periphery, forming a seal with the passage 70. A chamber 76 is defined between the lower end of the discharge cell 30 and the piston 72. The chamber 76 contains an inert gas, such as nitrogen, pressurized to approximately 800 pounds per square inch (psi), forcing the piston 72 against a snap ring 78 retained in a groove 80 in the interior wall of the axial passage. Extending from the lower face of the piston 72 may be a piston rod 82 which in turn may be coupled to a collect 84. The collet has its lower end received in the reduced diameter portion 70' of the axial passage. The collects receives and firmly grasps a head 86 of a stem 88 extending up into the cell from the unit below. The collect 84 may be a hollow cylinder which is split longitudinally into at least two, and preferably four pieces or fingers. It is preferred that the fingers be made from a material which allows the fingers to spread apart without suffering permanent deformation. The end of the collet 84 which receives the head 86 of the stem 88 may be shaped to conform to the shape of the head in order to firmly grasp it when the collet is inserted into the reduced diameter portion of passage 70'. A volume 90 is defined below the piston 72 and the next lower unit which contains an inert gas pressurized to approximately 600 psi. This reduced pressure existing on the lower side of the piston, buffers the force of the gas exerted upon the upper face of the piston 72, holding it against the snap ring 78.

Coupled to the lower end of the activation cell 32 may be the intake sub 34 seen in FIG. 3C. The intake sub 34 defines a concentric tubular passage 92 having a restriction 94 at an upper end, and is substantially concentric with the axial passages 70, 70'. Radially located around the central exterior portion of the intake sub may be at least one, and preferably two inlet ports 96 which are in fluid communication with passage 92 through a reduced diameter hole 98 located in the bottom of the inlet ports 96. The concentric passage 92 of the intake sub contains an intake piston 100 which may be coupled at its upper end 102 to the stem 88. The opposite end 104 of the intake piston 100 may be firmly coupled to a rod 106 to be discussed later. The outer periphery 108 of the intake piston 100 contains an annular channel 110 having a width similar to that of the reduced diameter holes 98 at the bottom of ports. Located around the exterior of the intake piston 100 on each side of the annular channel 11 are two sets of O-rings generally indicated as 112 to seal the intake piston 100 within the passage. The O-rings 112 on each side of the channel 110 are of the same size so that forces created on each side of the piston due to external pressure entering through the inlet ports 96 are balanced. Therefore, no matter what the ambient pressure may be, there is no net force in an axial direction on the intake piston 100 that might cause it to move. The two sets of 0-rings 112 also serve to clean the internal surface of the passage 92 as the intake piston 100 is moved to the open and closed positions as will be discussed below.

Figure 3D:
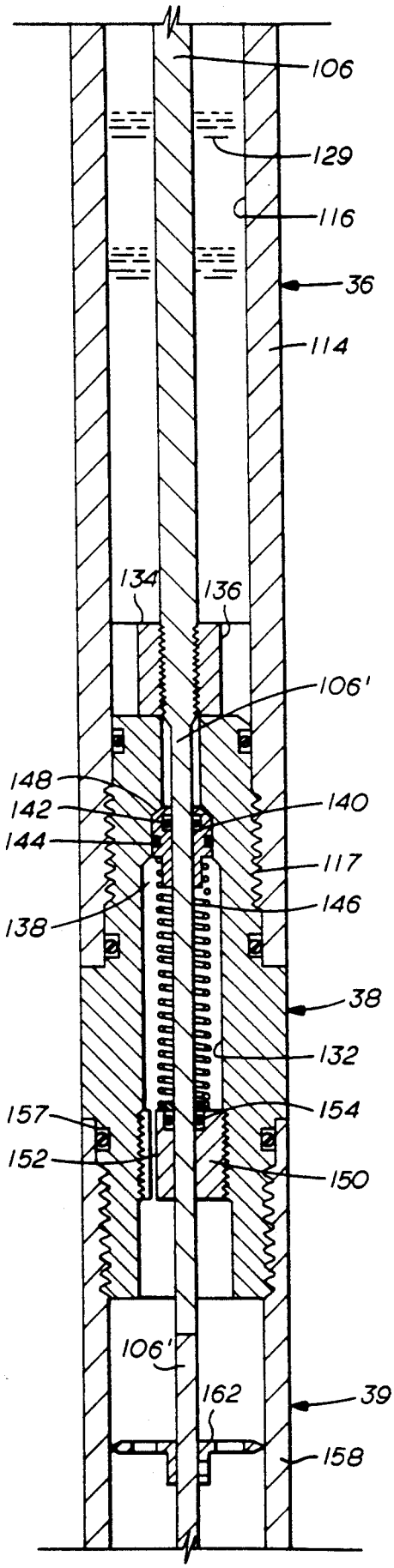

Also shown in FIGS. 3C and 3D, located beneath the intake sub 34 is the sample cell 36. The sample cell 36 comprises a tubular housing or cylinder 114 having a concentric longitudinal passage 116 with threaded ends generally indicated as 117. The cell 36 may be bipolar: that is it does not have a preferred coupling orientation in the sampler 10. Axially disposed within the passage 116 may be a rod 106 which extends the length of the sample chamber and is coupled to the bottom of the intake piston 100 mentioned above. Slidably disposed within the longitudinal passage 116 along the rod 106, and effectively butted against the bottom of the intake sub 34, may be a floating piston 118 having an axial passage 120. The floating piston 118, defining upper and lower faces 119 and 121 respectively, contains outer 0-ring seals 122 forming a seal with the walls of the longitudinal passage 116, and inner 0-ring seals 124 forming a seal with the rod 106. Located within the intake-sub passage 92, and adjacently above the floating piston 118 may be an agitation sleeve 126. The sleeve 126 is slidably received along the rod, is of the same outer diameter as the intake piston 100, and also contains an axial bore 128 concentric with the longitudinal passage 116. Both the floating piston 118 and the sleeve 126 are free to move up and down the stem 106 restricted in their upward travel by the intake sub 34. The intake sub 34 closes the upper end of the cell 36 using a threaded joint sealed by 0-rings generally indicated as 130. The volume defined by the lower end of the floating piston 118 and by the unit below, may be filled with a viscous fluid 129.

The lower end of the sample cell 36 may be closed by a restriction sub 38. The restriction sub 38 has an axial passage 132 extending therethrough which may be of uniform diameter or step-tapered with the diameter increasing downward, as shown in FIG. 3D. The axial passage 132 of the restriction sub 38 receives the lower end of the rod 106 which extends from the longitudinal passage 116. Located inside the sample cell and secured to the lower portion of the rod 106 adjacent the restriction sub 38 may be a stop 134. The stop 134 contains a plurality of holes 136 extending through the perimeter.

Located within the axial passage 132 of the restriction sub 38 may be a poppet valve mechanism generally indicated as 138. A poppet valve 140, containing inner and outer 0-rings 142 and 144 respectively, are received along a reduced diameter portion 106' of the rod 106. A spring 146 located behind the valve 14 forces the valve against a valve seat 148 defined within the passage 132. A screw 150 located at the lower end of the passage 132 may be used to adjust the compression force of the spring 146 against the valve 140. The screw 150 also contains a longitudinal orifice 152 and an O-ring 154 forming a seal with the rod 106'. The pressure exerted by the poppet valve mechanism 138 has been preadjusted. Orifice 152 in the restriction screw 150 prevents the viscous fluid in the sample cell from exiting the sample cell at a rate which would cause the bore hole fluid to "flash" as it entered the sample cell. Flashing of the collected sample would alter the phase of the fluid entering the sampler and defeat the purpose of the sampler. The poppet valve 138 also acts to release some of the viscous fluid as necessary to accommodate thermal expansion as the tool is lowered into the bore hole, and further to allow viscous fluid to be displaced during sampling.

Figure 3E:
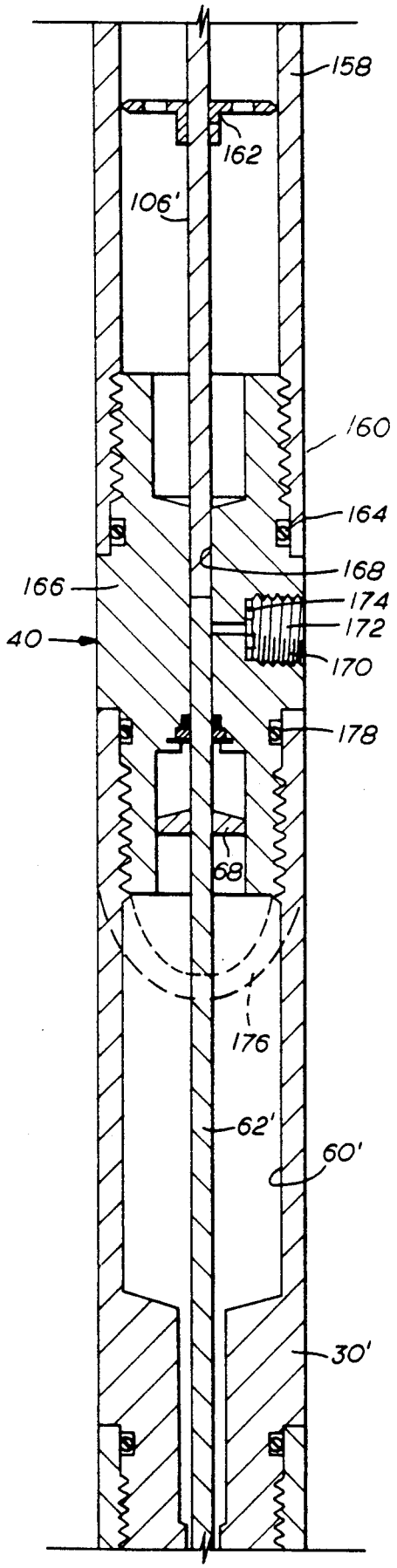

Refer to FIGS. 3D and 3E. Coupled below the restriction sub 38 and sealed by an O-ring 157, may be a secondary chamber 39. The chamber 39 is a cylinder 158 having its lower end 160 sealed by a relief or bleed-off sub 40. The secondary chamber 39 may be very similar to the sample cell 36: an exception being the volume of the secondary chamber 39 is substantially greater than the sample cell 36. Axially extending through the secondary chamber 39 may be the rod 106' which has at least one, but preferably two centralizers 162 located along its length. The secondary chamber 39 may be at atmospheric pressure and may be in fluid communication with the sample cell 36 through the longitudinal passage 132 of the restriction sub 38: the fluid communication controlled by the poppet valve mechanism 138 and the restriction screw 150.

As mentioned above, the secondary chamber 39 is closed at its lower end by a relief or bleed-off sub 40 and an O-ring 164. FIG. 3E generally illustrates the relief sub 40 is comprised essentially of a body 166 having an axial bore 168 for receiving the lower end of the rod 106'. Radially extending in from the exterior, and in fluid communication with the bore 168, may be a bleed-off port 170 sealed by a plug 172 and an O-ring 174. The bottom of the relief sub 40 may be closed by a nose cone 176 (shown in phantom) and O-ring 178.

If more than one tool is to be coupled in series, the units or cells as described above may be connected in the described sequence beneath the relief sub 40. A change in the configuration for the subsequent tools is shown in FIG. 3E. The only substantial change would be that the trigger 56 would not be connected to the activation stem 62' contained in the next discharge cell 30'. The activation stem 62' would abut directly against the lowest end of the rod 106' received in the relief sub 40.

The above description of the tool is as it exists prior to activation and taking of the fluid sample. When the sampler 10 is run down a bore hole 12, the sample cell 36 is above the secondary chamber 39. The floating piston 118 is floating on the viscous fluid 129 which occupies the annular area between the stop 134 and the floating piston 118. In the process of running the tool 10 down hole, gravitational forces on the floating piston 118 and on the viscous fluid 129 may try to force the viscous fluid 129 through the restriction sub 38 and into the secondary chamber 39. This may be prevented by the poppet valve mechanism 138 blocking any path the fluid might take. The force of the spring 146 is greater than the gravitational forces upon the viscous fluid 129 and the floating piston 118.

Internal pressures caused by the heating of the viscous fluid 129 in the sample cell 36 are exerted on the frontal or top portion of the poppet valve 140, creating a downward force against the spring 146. When the pressure exceeds the force exerted by the spring 146, the poppet valve 140 will open and fluid will pass the valve 140 and pass through the orifice 152 into the secondary chamber 39. In the process, the pressure inside the sample cell 36 will be relieved. By the use of the poppet valve 140, the sample cell 36 can be sealed to keep it completely full of viscous fluid 129, yet pressure will not build up due to thermal heating.

The above Figures show the sampler 10 and its components as they exist prior to activation. In the configuration shown, bore hole fluid 16 cannot enter the sample cell 36 through the sample inlet ports 96 because the intake piston 100 is in the sealing position. At the time of activation, the intake piston 100 is pulled upwards so that the O-ring seals on the intake piston 100 are above the inlet ports 96. Bore hole fluid 16 is now free to enter the sample intake sub 34. Once inside the intake sub 34, the bore hole fluid 16 has access to the sample cell 36 by way of the annular area around the rod 106 and inside the longitudinal passage of the sample intake sub 34. The agitation sleeve 126 is not an obstacle to this access since it is free to slide on the rod 106 and s will be swept down into the sample cell 36 by the force of the bore hole fluid 16 entering the tool 10. As the fluid enters the sampler 10, pressure inside will build and act upon the upper face 119 of the floating piston 118. The floating piston 118 will have pressure on the top face 119, but the viscous fluid 129 below the piston 118 will still be at atmospheric pressure. This imbalance of forces due to an imbalance in pressure will cause the floating piston 118 to move downward compressing the viscous fluid 129. As the fluid compresses, pressure will build and will act against the poppet valve assembly 138, causing the valve 140 to open and allow the viscous fluid 129 to pass through the restrictive orifice 152. At this point the viscous fluid 129 will have no where to go except through the orifice 152 and into the secondary chamber 39. Because the orifice 152 is small compared to the cross-sectional area of the sample inlet ports 96, the bore hole fluid 16 will be able to enter the inlets 96 much faster than the viscous fluid 129 can pass through the orifice 152. As a result, the entire flow path right from the inlet ports 96 to the upstream side of the orifice will pressure up to the same pressure as the bore hole pressure. The entire process of pressurizing will occur almost instantaneously after opening the inlet ports 96. The net result is that during the filling process, no pressure drop occurs at the sample inlet ports 96 because the entire sample cell 36 is at bore hole pressure. All the pressure drop occurs across the orifice 152. In effect, the orifice 152 is creating a back pressure.

It is desirable to prevent a pressure drop at the inlet ports 96 during filling of the sample cell 36 because a phenomena known as "flashing" can occur to the bore hole fluid 16 if it is subjected to a significant pressure drop upon entering the tool. When flashing occurs, the fluid 16 often separates into two phases, liquid and gas. The gas expands occupying most of the space inside the sample cell 36. The net result is an insufficient quantity of sample collected. This situation is to be avoided and for this reason the viscous fluid 129 is displaced through the orifice 152 to create the back-pressure and thus a negligible pressure drop at the sample inlet ports 96.

As the bore hole fluid 16 enters the sample cell 36, displacing the viscous fluid 129 to the secondary chamber 39, the floating piston 118 moves from the top of the sample cell 36 towards the bottom. The floating piston 118 has seals, internal and external as mentioned above which seal on the rod 106 and the internal wall of the cell 36. The seals ensure that the viscous fluid is completely displaced so that no contamination of the bore hole fluid sample occurs.

When the sampler 10 is in the open position, the intake piston 100 is moved fully upward against the inside shoulder of the sample intake sub 34. The intake piston 100 is fixed to the rod 106 which in turn is fixed to the stop 134 located at the opposite end of the sample cell 36. Thus, in the open position, the stop 134 is drawn upwards and away from the upper end of the restriction sub 38 the same distance the intake piston 100 has moved. As the sampler 10 fills with the sample fluid 16, the intake piston 100 and the stop 134 remain in the open position until the floating piston 118 urges the stop 134 back against the restriction sub 38. The moving of the stop 134 against the restriction sub 38 also results in the closing of the intake piston 100 over the inlet ports 96. As long as pressure is maintained within the sample cell 36, the floating piston 118 will keep the cell 36 closed. The pressure within the cell 36 also acts against the intake piston 100, but does not move because of the areal differences of the piston faces. That is to say that the area of the intake piston exposed to the pressure is less than the area of the floating piston exposed to the same pressure.

The secondary chamber 39 acts as a volume to discard the viscous fluid 129 The viscous fluid 129 could not be displaced to the bore hole since the pressure at the exit point would be the same as at the inlet ports 96. Hence, there would not be a driving force to cause displacement of the floating piston 118 and the viscous fluid below it. In order to have flow there must be a pressure differential, that is, a region of higher pressure where the flow originates and an area of lower pressure where the flow terminates. For this reason the secondary chamber 39 is maintained at atmospheric pressure prior to running the sampler 10. Atmospheric pressure in the secondary chamber 39 is maintained by the O-ring seals 157 and 164. The upper O-ring 157 seals with the restriction sub 38, and the lower O-ring 164 forms a seal with the relief sub 40 and the nose cone 176 and O-ring 178.

As can be inferred from the description of the activation cell 32 above, the energy source which opens the intake piston 100 during a sampling sequence is the compressed gas, preferably nitrogen. As briefly described above, the activation cell 32 is essentially a fluid-operated ram. Between the top of the piston 72 and the face of the discharge cell 30 is a volume of gas pressurized to approximately 800 psi. As well, there is a volume of gas pressurized to approximately 600 psi between the piston 72 and the intake piston 100. The 600 psi gas pushes up against the piston 72 and down against the intake piston 100. Because the piston 72 has a larger surface area exposed to the gas than does the intake piston 100, there is net upward force trying to open the intake piston 100. The net upward force, however, is less than the downward force exerted by the 800 psi gas upon the upper face of the piston 72, maintaining the intake piston 100 in the closed position over the inlet ports 96.

When a DC voltage is applied down the wire line 14 to the sampler 10, the motor 44 rotates the conical cam 48. Alternatively, a mechanical clock could also be used to rotate the cam 48. The slot in the cam 48 receives the tip of the trigger 56 to fall past the cam. Once the trigger 56 falls into the slot of the cam 48, the trigger allows the activation stem 62 to move upwards. The activation stem 62 clears the port in the discharge cell 30, allowing the 800 psi gas in the small chamber 76 to exhaust through the port into the volume of the discharge cell 30 and a portion of the motor/clock housing 28. The discharge of gas from the small chamber 76 will contain negligible pressure to overcome the pressure exerted by the 600 psi volume of gas upon the lower face of the piston 72.

Because of the different facial areas of the piston 72 and the intake piston 100, a net upward force is exerted upon the piston 72, moving the intake piston 100 upwards as well. Once the intake piston 100 has cleared the inlet ports 96, the lower end of the collet 84 grasping the head of the stem 88 will have cleared the narrow portion of the passage 70'. The fingers of the collet 84 are no longer constrained by the passage 70' and allowed to open, releasing the head of the stem. This release mechanism allows the floating piston 118, moving downward by the flowing fluid, to close the intake piston 100 without having to act against the 600 psi of gas in the activation cell 32.

Once the fingers release the stem, the piston 72 and the collet 84 are forced against the bottom face of the discharge cell where they remain until the sampler is reloaded. The intake piston does not close until the bore hole fluid allowed to enter the sample cell forces the floating piston 118 against the stop 134 as described above.

It is important to note here that the sample has been collected at ambient pressure and temperature much greater than exists at the surface. As the tool is raised to the surface, the tool and fluid therein cool. This cooling effect has in previous tools created a vacuum causing the valves to open and allow fluids from uphole to enter, or to allow degassing of the fluid within the sampler. The tool of this invention prevents this from occurring. First, if the bore hole fluid within the housing were to cool and create a vacuum, the intake piston would be drawn downward and act as a barrier between the ambient and the bore hole fluid within the sampler. Alternatively, the intake piston is prevented from moving upwards by the pressure exerted by the gas below the piston 72. The gas within chamber 90 acts upon the head 86 and the upper surface 102 of intake piston 100, forcing the piston downward.

It is also important to note here the added benefit obtained from this invention. After the sample is collected, and if during the sampling process some of the bore hole fluid flashed, the fluid my be returned to a single phase fluid during extraction of the fluid from the sampler. The fluid may be extracted from the sampler by coupling hoses to the intake ports. A fluid is introduced from beneath the floating piston thus increasing the pressure within the sample chamber. The agitation sleeve 126 is moved back and forth along the rod 106 by tilting the assembly. As the agitation sleeve moves back and forth, it breaks up the gas bubble existing within the fluid and assists in resaturating the gas in the fluid. Once sufficient pressure has been applied to the bore hole fluid and has been agitated, the sample is removed from the sample chamber. The use of the agitation sleeve removes the need to use other materials such as mercury to agitate the gas bubble in the fluid to assist in resaturation.

An alternative embodiment for activating the system employs a clock mechanism briefly mentioned above instead of the electrical motor 44. The motor 44 is replaced by a spring driven timing device sufficient for triggering the entire sampler 10 as described above. The advantage to this embodiment is that electrical power no longer need be supplied through the wire line, providing a less expensive support vehicle for the sampler 10 in the bore hole 12.

This invention has been described with a particular degree of specificity. Variations will occur to those skilled in the art which are to be considered within the scope and spirit of this invention which is limited only by the appended claims.

We claim as our invention:

1. An apparatus, suspended in a bore hole from the surface of the earth, for taking a sample of a fluid from the bore hole, comprising in combination: a housing having at least one port and an interior volume, means for opening the port thereby placing the volume in fluid communication with the fluid in the bore hole, means within the volume for accepting the fluid from the bore hole at a predetermined rate so as not to alter the fluid, means within the volume for agitating the bore hole fluid received therein, and means within the housing for closing the port, sealing the bore hole fluid within the volume once the volume is full.

2. The apparatus as recited in claim 1, wherein the means for opening and closing the port, placing the volume in fluid communication with the bore hole, comprises in combination:

a. intake means, slidably disposed within the housing for sealing the port in a closed position; and b. means for moving said intake means from the closed position to an open position adjacent the port.

3. The apparatus as recited in claim 1, wherein the means within the volume for accepting the fluid from the bore hole at a predetermined rate so as not to alter the fluid, comprises in combination:

a. a first fluid within the housing at a first pressure;

b. means for forcing the first fluid from the housing upon receipt of the fluid from the bore hole at a second pressure greater than the first pressure;

c. means for restricting the flow of the first fluid from the housing at a predetermined rate.

4. An apparatus for capturing a sample of fluid from a bore hole, comprising in combination:

a. a housing defining at least one volume and having at least one port for placing the volume in fluid communication with the fluid in the bore hole;

b. intake means, disposed within the housing for opening the port to allow entry of the fluid in the bore hole into the volume;

c. restriction means coupled to the housing, for controlling the rate at which the fluid is received by the volume;

d. floating means, disposed within the volume, for closing the port when the volume is full, thereby retaining the sampled fluid at a pressure at which is was collected; and e. means, disposed within the volume, for agitating the sampled fluid within the volume.

5. An apparatus as recited in claim 4, wherein the intake means comprises in combination:

a. an intake piston slidably disposed within the volume and slidably positioned over the port;

b. means, coupled to the housing, for moving the intake piston from a first sealing position over the port to a second open position adjacent the port; and c. means, positioned on the intake piston, for cleaning the port when opened and closed.

6. An apparatus as recited in claim 4, wherein the restriction means, comprises:

a. a first fluid within the volume of the housing;

b. a piston, separating the fluid from the port;

c. means, having a first and a second position, coupled to the housing and in fluid communication with the volume for venting the first fluid from the volume of the housing at a predetermined pressure exerted by the first fluid upon the venting means; and d. means, coupled to the housing, for receiving the first fluid vented from the volume of the housing.

7. The apparatus as recited in claim 4, wherein the floating means disposed within the volume for closing the port when the volume is full, comprises:

a. a piston slidably disposed within the volume of the housing;

b. a rod extending the length of the volume and coupled to the intake means; and c. stop means, located at an end of the rod within the volume opposite the port, for engaging the piston as the volume is filled by the fluid from the bore hole, the piston urges the stop away from the port, pulling the intake means over and closing the port.

8. The apparatus as defined in claim 4, further comprising means coaxial with the floating means for agitating the fluid within the housing and received from the bore hole.

9. An apparatus, for capturing a sample of fluid from a bore hole penetrating the surface of the earth, comprising in combination:

a. a sample cell having at least one port, for receiving the fluid from the bore hole;

b. opening means, coupled to the sample cell for opening the port, the opening means including a fluid-operated ram release mechanism and trigger mechanism;

c. means, within the sample cell, for controlling the rate the fluid is received by the sample cell, the controlling means closing the port when the sample cell is full thereby retaining the sampled fluid at a pressure at which is was collected; and d. means freely sliding within the sample cell for mixing the sampled fluid.

10. An apparatus as recited in claim 9, wherein the sample cell further comprises in combination:

a. a chamber defined within the sample cell and in fluid communication with the bore hole through at least one port;

b. a rod extending the length of the chamber;

c. a floating piston received along the rod and located at an end of the chamber near the port forming a seal with the rod and the chamber; and d. a viscous fluid disposed on a side of the floating piston opposite the port.

11. The apparatus as defined in claim 9, wherein the opening means comprises:

a. means, slidably disposed over the port, for preventing the bore hole fluid from entering the sample cell;

b. means, clamping the preventing means, for drawing the preventing means from over the port allowing the bore hole fluid to enter the sample cell.

12. The apparatus as defined in claim 11, wherein the opening means comprises:

a. an intake piston having a rod extending from a first end, sealing the port of the sample cell b. a collet, clamped about an end of the rod extending from the intake piston, the collet coupled to the fluid operated ram release mechanism; and c. means for maintaining the collet clamped about the rod of the intake piston for a fixed period of time during the operation of the apparatus.

13. The apparatus as defined in claim 12, wherein the triggering mechanism is an electrical motor having a cam at one end for engaging a rod coupled to the piston separating the first and second pressurized chambers in the activation cell.

14. The apparatus as defined in claim 12, wherein the triggering mechanism is a mechanical clock having a cam at one end for engaging a rod coupled to the piston separating the first and second pressurized chambers in the activation cell.

15. The apparatus as defined in claim 11, wherein the means within the sample cell for controlling the rate the fluid is received by the sample cell, comprises:

a. a first fluid substantially filling the sample cell;

b. a piston member disposed between the first fluid and the port in the sample cell; and c. a restriction means located at an end of the sample cell opposite to the port, the restriction means in fluid communication with the first fluid in the sample cell upon receipt of the fluid from the bore hole through the port into the sample cell, the restriction means allowing the first fluid to be displaced from the sample cell at a rate so as not to cause the fluid from the bore hole to change phase upon entry into the sample cell.

16. The apparatus as defined in claim 15, wherein the restriction means, comprises:

a. a discharge chamber coupled to the end of the sample cell opposite the port, for receiving the first fluid discharged from the sample cell;

b. a poppet valve located in an end of the discharge chamber coupled to the sample cell, the poppet valve urged in a closed position by an adjustable compression spring opened by a predetermined pressure exerted by the first fluid within the sample cell; and c. an orifice associated with the poppet valve for metering the rate of flow of the first fluid from the sample cell into the discharge chamber.

17. An apparatus as defined in claim 9, wherein the means for controlling the rate at which the fluid from the bore hole enters the sample cell, comprises a poppet valve in fluid communication with the sample cell, for restricting the flow rate at which the fluid from the bore hole is accepted into the sample cell.

18. An apparatus as defined in claim 9, wherein the means are provided for tandemly coupling at least one other apparatus for sampling fluid from a bore hole.

19. An apparatus as defined in claim 9, wherein dual O-ring seals exist between all of the couplings to prevent explosive decompression of the contained fluid upon return to the surface of the earth.

20. An apparatus suspended in a bore hole for sampling a fluid, comprising in combination:

a. a housing with at least one port and an internal chamber for receiving the fluid from the bore hole at an ambient pressure present at a depth the fluid is sampled;

b. activation means, coupled to the housing, for opening the port and placing the internal chamber in fluid communication with the fluid in the bore hole at a predetermined time, the activation means further comprising:

1. ram means, moving from a first position to a second position by a fluid; and 2. an inlet piston, detachably coupled to the ram means, for blocking the port with the ram means in the first position, and opening the port in the second position and thereby allowing the bore hole fluid to enter the chamber;

c. restriction means, coupled to the housing, for controlling the rate at which the fluid from the bore hole flows into the chamber; and d. means, slidably disposed within the chamber, for closing the port when the housing is full of the fluid to be sampled.

21. An apparatus as defined in claim 20, wherein the internal chamber of the housing for receiving the fluid from the bore hole has substantially an empty volume to prevent contamination of the bore hole fluid by atmospheric elements as it is received by the internal chamber.

22. The apparatus as defined in claim 20, wherein the restriction means, comprises:

a. a chamber coupled to the sample cell opposite the port;

b. valve means located at an end of the chamber coupled to the sample cell, the valve means urged opened by a predetermined pressure from a fluid within the sample cell; and c. orifice means in the valve means for metering a flow rate of the fluid from the sample cell into the chamber.

23. The apparatus as recited in claim 20, wherein the means within the housing for closing the port when the chamber is filled with the fluid to be sampled, comprises:

a. stop means located at an end of the housing opposite the port and coupled to the intake means; and b. floating means, slidably disposed within the volume and forced against the stop means by the entering bore hole fluid for moving the intake means from the open position back to the closed position over the port and sealing the bore hole fluid within the housing.

24. The apparatus as defined in claim 23, wherein the fluid-operated ram means, comprises:

a. an activation cell coupled to a first end of the housing;

b. a first and second pressurized chamber within the activation cell defined by a piston having a rod extending from a lower end thereof and coupled to the collet, the pressure in the first chamber greater than the pressure in the second chamber, thereby forcing the piston downward; and c. means within the activation cell and coupled to the triggering mechanism, for releasing the pressure in the first pressurized chamber upon a command from an operator, allowing the piston therein to move upwards, drawing the rod and attached collet upwards and moving the intake piston from over the port.

25. An apparatus, coupled to a triggering means and suspended in a bore hole from the surface of the earth, for sampling a fluid from the bore hole at a predetermined depth, comprising in combination:

a. a housing, having a first and a second end and an internal chamber at a first pressure, and having at least one port, for receiving the fluid from the bore hole at an ambient pressure greater than the first pressure;

b. a fluid operated ram interconnecting the first end of the housing and the triggering means, for opening the port and placing the chamber in fluid communication with the fluid in the bore hole;

c. an intake piston releasably coupled to the fluid operated ram, the intake piston releasably coupled to the fluid operated ram, the intake piston sealing the port in a first closed position, and opening the port in a second open position;

d. means, coupled to the second end of the housing, for controlling the rate at which the fluid flows into the chamber;

e. means, slidably disposed within the chamber for closing the port when the housing is filled with the fluid to be sampled; and f. means slidably axially within the chamber for mixing the fluid to be sampled.

26. The apparatus as defined in claim 25, wherein the internal chamber of the housing for receiving the fluid from the bore hole initially has a volume substantially equal to zero to prevent contamination of the bore hole fluid by atmospheric elements as it is received by the internal chamber.

27. The apparatus as defined by claim 26, wherein the fluid operated ram release mechanism, comprises:

a. an activation cell coupled to a first end of the housing;

b. a first and a second pressurized chamber within the activation cell defined by a piston having a rod extending from a lower end thereof terminating in a collet, the pressure in the first chamber greater than the pressure in the second chamber, thereby forcing the piston downward; and c. means within the activation cell and coupled to the triggering mechanism, for releasing the pressure in the first pressurized chamber upon a command from an operator, allowing the piston therein to move upwards, drawing the rod and attached collet upwards and moving the intake piston from over the port.

28. The apparatus as recited in claim 25, wherein the means for controlling the rate at which the fluid flows into the chamber, comprises:

a. a housing;

b. a viscous fluid substantially filling said housing;

c. means, in fluid communication with the fluid in the bore hole, for forcing said viscous fluid from said housing; and d. means, coupled to said housing and in fluid communication with said viscous fluid, for restricting the rate of flow of the viscous fluid from said housing by the forcing means.

29. The apparatus as defined in claim 28, wherein the means for forcing said viscous fluid from said housing comprises a piston slidably disposed within said housing and separating the viscous fluid from the fluid within the bore hole.

30. The apparatus as defined in claim 25, wherein the means, slidably disposed within the chamber for closing the port when the housing is filled with the fluid to be sampled, comprises:

a. a rod slidably disposed within the chamber and attached to the intake piston;

b. a floating piston slidably disposed along the rod and free to move within the chamber upon receipt of the fluid from the bore hole;

c. a stop fixed to an end of the rod opposite the intake piston and engaged by the floating piston when the chamber is substantially full of the fluid from the bore hole, pulling the intake piston closed over the port and sealing the chamber.

* * * * *